United States Patent [19]

Ahroni

[11] Patent Number: 4,899,266

[45] Date of Patent: Feb. 6, 1990

[54] MINIATURE LIGHT SETS AND LAMPHOLDERS AND METHOD FOR MAKING THEM

[76] Inventor: Joseph M. Ahroni, 2701 W. Manor Pl., #204, Seattle, Wash. 98199

[21] Appl. No.: 290,239

[22] Filed: Dec. 22, 1988

Related U.S. Application Data

[63] Continuation-in-part of Ser. No. 131,027, Dec. 10, 1987, Pat. No. 4,807,098, which is a continuation-in-part of Ser. No. 945,602, Dec. 22, 1986, Pat. No. 4,779,177, which is a continuation-in-part of Ser. No. 664,153, Oct. 24, 1984, Pat. No. 4,631,650.

[51] Int. Cl.[4] ..... F21V 33/00

[52] U.S. Cl. ..... 362/238; 362/252; 362/806; 439/736

[58] Field of Search ..... 362/226, 227, 234, 237, 362/238, 249, 252, 806; 315/185.5; 439/736, 602, 605

[56] References Cited

U.S. PATENT DOCUMENTS

| | | | |
|---|---|---|---|
| 1,974,472 | 9/1934 | Seghers | 362/249 X |
| 2,506,620 | 5/1950 | Sundt | 362/249 X |
| 2,802,083 | 10/1957 | LaPeyre | 339/97 R |
| 2,965,875 | 12/1960 | Danesi | 339/180 |
| 3,005,177 | 10/1961 | Wieckmann | 439/419 |
| 3,206,712 | 9/1965 | Schick et al. | 439/419 |
| 3,214,579 | 10/1965 | Pacini | 362/227 |
| 3,404,453 | 10/1968 | Moranduzzo | 29/628 |
| 3,551,723 | 12/1970 | Van Groningen | 313/250 |
| 3,601,967 | 8/1971 | Eckles | 339/99 L |
| 3,609,643 | 9/1971 | Connan | 339/97 L |
| 3,708,608 | 1/1973 | Wyman | 174/70 R |
| 3,867,621 | 2/1975 | Gewfrtz et al. | 339/97 L |
| 3,873,885 | 3/1975 | Elfverson | 315/312 |
| 3,874,762 | 4/1975 | Shott et al. | 339/91 R |
| 4,159,157 | 10/1988 | Koehler | 339/97 L |
| 4,178,061 | 11/1979 | Ahroni | 337/196 X |
| 4,197,154 | 4/1980 | Pfaff, Jr. | 174/117 F |
| 4,263,640 | 4/1981 | Altman | 362/227 X |
| 4,631,650 | 12/1986 | Ahroni | 362/249 |
| 4,778,409 | 10/1988 | Maddock | 439/736 X |

FOREIGN PATENT DOCUMENTS

| | | |
|---|---|---|
| 258112 | 4/1912 | Fed. Rep. of Germany . |
| 6508093 | 12/1966 | Netherlands . |
| 368023 | 3/1932 | United Kingdom . |

*Primary Examiner*—Stephen F. Husar
*Attorney, Agent, or Firm*—Seed and Berry

[57] ABSTRACT

A lampholder for miniature light sets, which may be of two-piece snap-together construction or a molded, one-piece unit, has a socket at one end to receive a push-in lamp unit and a wireway at the opposite end. The socket receives two identical push-in contact plates which are laterally reversible so that in one position they project by a respective insulation-severing element into one portion of the wireway to engage a first wire, and in a second position the severing element projects into a second portion of the wireway to engage a second wire. The wires are preferably contained in an insulated cord having cutouts at regular intervals which are located in the lampholders to be bridged via the contact plates and lamp units for a series connection. The lampholders at the ends of each series may have one of their contact plates reversed to engage non-interrupted wires in the cord to provide a serial-parallel arrangement. The cutouts may be formed at the location where the lampholders are applied to the cord or previously.

24 Claims, 3 Drawing Sheets

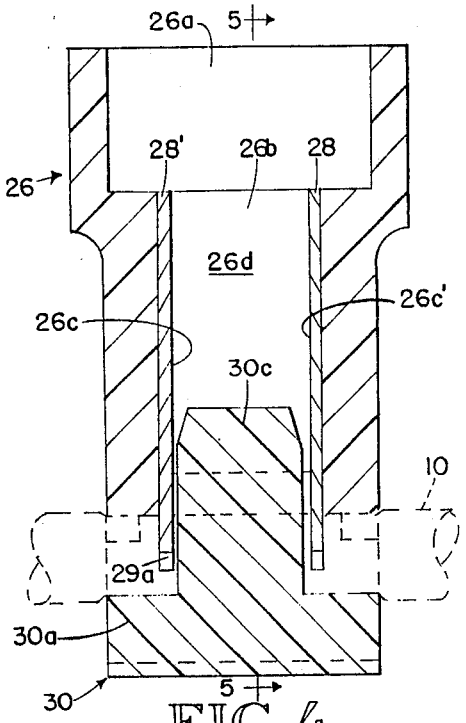
FIG. 4
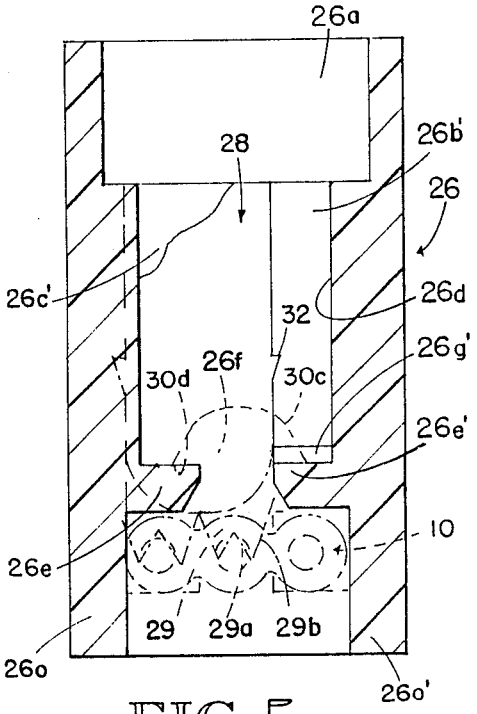
FIG. 5
FIG. 6
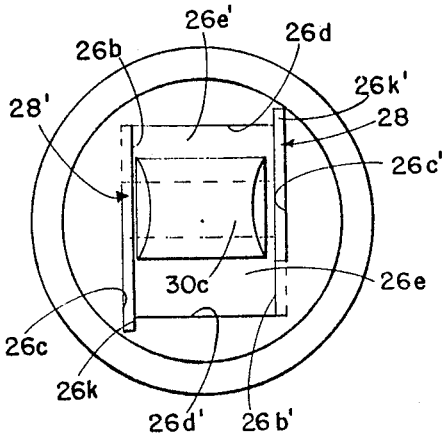
FIG. 7
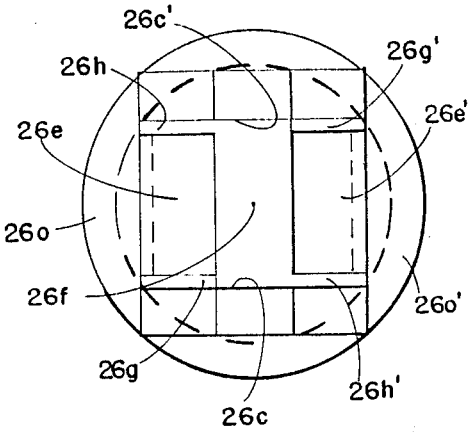

FIG. 8
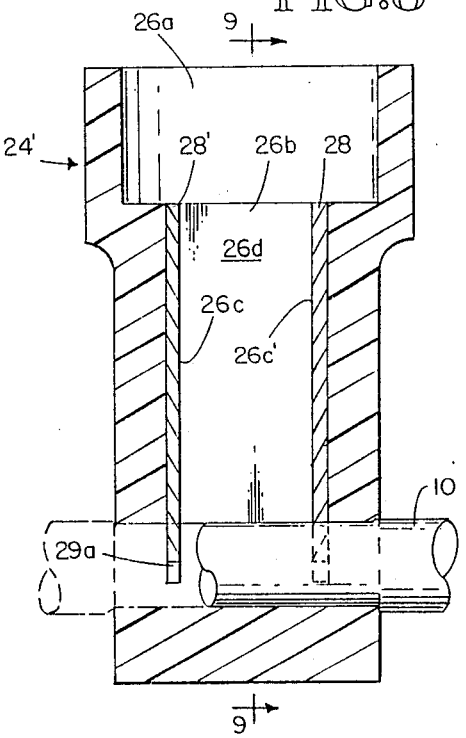
FIG. 9
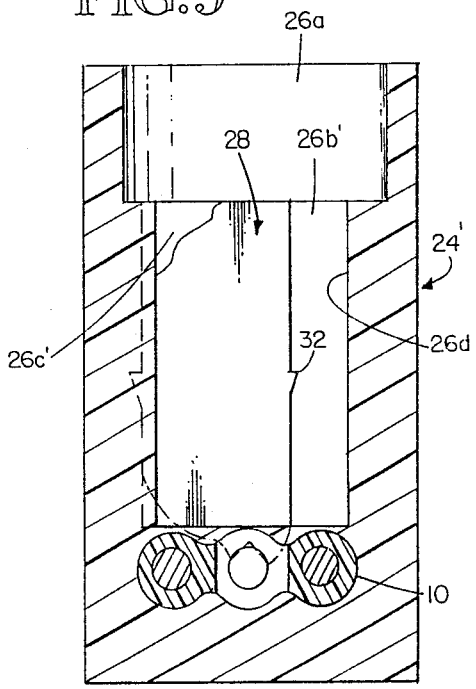
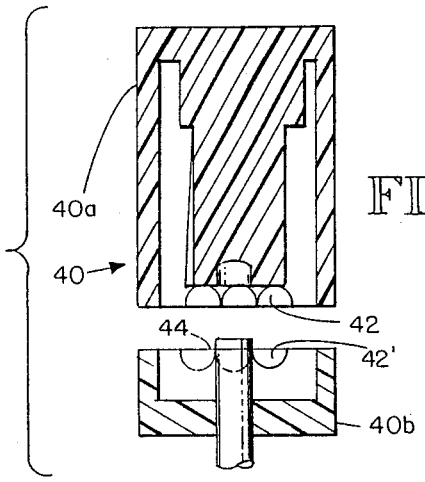
FIG. 10

MINIATURE LIGHT SETS AND LAMPHOLDERS AND METHOD FOR MAKING THEM

RELATED APPLICATIONS

This application is a continuation-in-part of my copending application Ser. No. 131,027, filed Dec. 10, 1987, now U.S. Pat. No. 4,807,098, which is a continuation-in-part of Ser. No. 945,602, filed 12-22-86, now U.S. Pat. No. 4,779,177, which is in turn a continuation-in-part of Ser. No. 664,153, filed 664,153, now U.S. Pat. No. 4,631,650.

TECHNICAL FIELD

The present invention relates to lampholders for series-parallel strings of lights, and particularly to those having miniature pushing type bulbs operating at relatively low voltage. Aspects of the invention are applicable, however, to larger bulbs and other types of light sets.

BACKGROUND ART

Decorative light strings in which all of the bulbs are in a single series have the disadvantage that if one bulb fails to light, the entire string goes out and it may be difficult to determine which light failed. Also, in a series string, the voltage available for each light is the line voltage divided by the number of bulbs. If, on the other hand, all the bulbs are in a parallel arrangement, failure of one of the bulbs does not affect the others, but each bulb is subjected to the full line voltage unless a transformer is used.

A suitable compromise between a series lighting circuit and a parallel lighting circuit is one in which sets of series-arranged bulbs are wired in parallel relation to make up a string. This is called a "series parallel" string. In such a string, the voltage for each light is the line voltage divided by the number of bulbs in each set. If a bulb fails in a series-parallel string, only the bulbs in the series set containing that bulb will fail to light. Hence, there are fewer bulbs to check to find the faulty bulb than in a string where all the bulbs are in a single series string.

Normally, in a series-parallel string of miniature push-in type bulbs, the lampholders in each series set are interconnected by using multiple short lengths of insulated lead wire connected to contact plates in a manner similar to that shown, for example, in U.S. Pat. No. 3,104,924. The lead wires to and from the first and last lampholders in each series set are connected, respectively, to parallel wires from the wall plug. Alternatively, the connection to the parallel wires is made by interrupting the parallel wires at the first and last bulbs of each series set and connecting both interrupted ends to the appropriate contact plate of the first and last lampholders. Hence, assembly of a series-parallel string of miniature lights has involved the handling and end-stripping of many pieces of wire, and normally there has been a need to wind the series wires and the parallel wires together between the bulbs for ease of handling when applying the string to a Christmas tree.

DISCLOSURE OF THE INVENTION

The present invention provides an improved lamp holder preferably used in conjunction with an insulated three-strand cord, making it unnecessary to use multiple short lengths of wire, and making it possible to have all of each lampholders identical and to make both contact elements in the lampholder identical, thus making it more economical and faster to assemble a string.

In carrying out the invention, two-piece lampholder housings are provided with a snap-on cover at their base end which forms a wireway for the cord with the rest of the housing, one-piece lampholder housings are provided which are injection-molded onto the cord. Two identical contact plates in each lampholder have insulation-severing contact elements projecting into the wireway to pierce the insulation of the cord and make the proper electrical connection to the wire. The cord has three side-by-side wires separated by insulation, the outer two wires being the parallel wires of the circuit and the center wire providing the series connection wires. The center wire is preformed with cutouts for the lampholder locations. When the two-piece lampholders are used, the lampholder covers have cover-fastening means passing through the respective cutout to separate the ends of the center wire exposed at the cutout as well as securing the cover in place. When the one-piece lampholders are used, the cutouts in the center wire can be filled with plastic when the lampholders are molded or can be left unfilled.

Each contact plate has an insulation-piercing element to engage the center wire and make a series connection via the bulb across the cutout in the center wire. As part of the present invention, each of the contact plates is laterally reversible so as to alternatively position its piercing element in engagement with the center wire or one of the other two wires in the cord. Thus, the lead-in contact plate can be reversed in the first lampholder in each series set and the lead-out contact plate of the last lampholder in each series set may be reversed to engage the appropriate one of the outer parallel wires so as to make the parallel connection for the series set.

If precut, the cutouts in the center wire are useful for properly positioning the cord when the two-piece lampholders are assembled on the wire, or when the one-piece lampholders are positioned in the mold. The snap-on cover of the two-piece lampholders has a positioning element onto which the cutouts are placed. The mold for the one-piece lampholders has a positioning pin onto which the cutouts are placed. As an alternative, this positioning pin can be used as a punch to form the cutouts.

BRIEF DESCRIPTION OF THE DRAWINGS

FIG. 4 is a longitudinal sectional view of the lampholder with the cover in place and taken as indicated by line 44 in FIG. 3.

FIG. 5 is a longitudinal sectional view of the lampholder taken as indicated by line 5–5 of FIG. 4, but with the cover shown in phantom and with the alternative position of the illustrated contact plate shown in phantom.

FIG. 6 is a top plan view of the two-piece lampholder with the cover in operative position.

FIG. 7 is a bottom plan view of the two-piece lampholder housing before insertion of the conductor plate elements.

FIG. 8 is a longitudinal sectional view of the one-piece lampholder taken in the manner of FIG. 4.

FIG. 9 is a longitudinal sectional view of the one-piece lampholder taken as indicated by line 9–9 in FIG. 8.

FIG. 10 is a longitudinal sectional view of a mold for making the one-piece lampholder and taken in correspondence with FIG. 9.

DETAILED DESCRIPTION OF THE INVENTION

Figure 2:
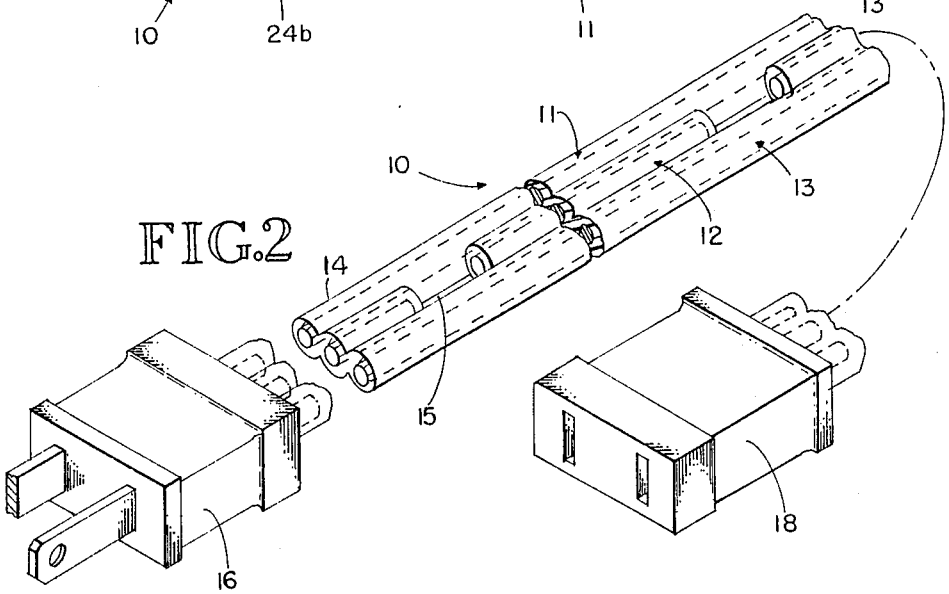
FIG. 2 is an isometric view showing a power cord with cutouts used with the present invention.

As shown in FIG. 2, there is provided an insulated cord 10 having three wires 11, 12, and 13 arranged in generally coplanar relation as a ribbon and separated by insulation 14. The cord 1 has a series of cutouts 15 severing and passing through the center wire 12 and spaced apart along the length of the cord according to the desired spacing of the lampholders. At its ends, the cord 10 is provided with a wall plug 16 and an add-on socket 18. The outer two wires 11, 13 are electrically connected to the two contacts of the plug 16 and socket 18, and the center wire 12 deadends within the plug and socket.

Each lamp unit of the invention has a miniature push-in type lamp assembly comprising a bulb 20 and a lamp base 22 in which the lamp 20 is mounted, and has a lampholder unit 24 receiving the lamp base. The lampholder unit 24 has a husk or housing 26, two identical push-in brass contact plates 28-28', and a cover 30.

As is common in the decorative lighting string art, each lamp 20 seats in a circular socket **22*a* in the lamp base 22. The latter is necked beneath the socket 22*a* and has an extension 22*b* with a generally rectangular cross section which tapers at the outer end to assist in entry into the lampholder housing 26. The lamps 20 have a pair of wire leads 20*a* extending therefrom. These leads 20*a* extend from the circular socket portion 22*a* of the lamp base 22 through respective longitudinal passages in the extension 22*b* and double back over opposite faces 22*c*** of the extension.

The lampholder housing 26 has a cylindrical socket portion **26*a* to receive the socket portion 22*a* of the lamp base 22, and has a generally rectangular bore extension 26*b*. This bore extension has the wider two of its opposite sides formed with a laterally stepped configuration to provide recessed faces 26*c*, 26*c'*, each extending about two-thirds of the wider width of the bore extension 26*b*. Significantly, the recessed faces 26*c*, 26*c'*** extend laterally in opposite directions so that only about half of the width of each of the recessed faces is positioned directly opposite the other.

The narrower faces **26*d*, 26*d'* of the bore extension 26*b* extend longitudinally from the socket portion 26*a* to a pair of opposed, cantilevered base flanges 26*e*, 26*e'* of generally rectangular configuration in plan view which are separated by a base entry 26*f*. At one of their ends, the base flanges 26*e*, 26*e'* are separated from the rest of the body of the housing 26 by slots 26*g*, 26*g'* which terminate shortly above the base flanges, as seen in FIG. 5. At their other ends, the base flanges 26*e*, 26*e'* are separated from the rest of the body of the housing 26 by slots 26*h*, 26*h'* which continue laterally from the recesses providing the bore extension faces 26*c*, 26*c'*. Preferably, the recesses providing the bore extension faces 26*c*, 26*c'* are extended laterally outward as longitudinal keeper grooves 26*k*, 26*k'***, best seen in FIG. 6.

The base entry **26*f* connects the bore extension 26*b* with a wireway 26*m* that is also intersected by the slots 26*h*, 26*h'* and the keeper grooves 26*k*, 26*k'*. The longitudinal sides of the wireway 26*m* are defined by opposed housing base extensions 26*o*, 26*o'* which have a height adequate to laterally confine the cord 10 and the cover 30**.

The cover 30 has a rectangular base **30*a* of a size to fit between the housing base extensions 26*o*, 26*o'* and cover the underside of the wireway. At its upper side, the cover 30 has a central projecting divider leg 30*b* formed with a tapered keeper head 30*c*. This head is formed with a pair of keeper faces 30*d* at opposite sides for engaging the upper faces of the base flanges 26*e*, 26*e'*, as shown in phantom in FIG. 5. The housing 26 and cover 30 are injection-molded plastic selected to have sufficient resiliency to permit the keeper head 30*c* to snap-fit into position responsive to pushing through the entry 26*f* between the flanges 26*e*, 26*e'*. As shown in FIG. 5, the mouth of the entry 26*f* is preferably tapered along the opposed longitudinal edges of the flanges 26*e*, 26*e'***.

Figure 3:
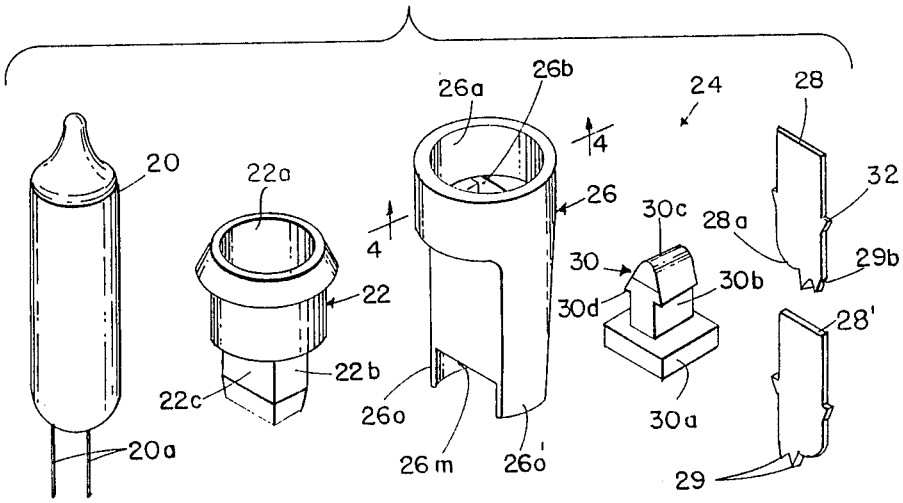
FIG. 3 is an exploded isometric view of a lamp unit of the present invention with a two-piece lampholder for use in the light string of FIG. 1.

Referring to FIGS. 3 and 5, the contact plates 28, 28' each have a pair of tapered fingers 29 which have opposed insulation-severing edges **29*a* and function as contact elements. These fingers 29 are adapted to pierce the insulation around a wire until the wire nests at the narrow end of the tapered slot between the fingers so that contact is made between the fingers and the wire, as indicated in FIG. 5 with respect to the center wire 12 shown in phantom. The contact plates 28, 28' are inserted through the cylindrical socket portion 26*a* of the housing in alignment with the slots 26*h*, 26*h'* so that the outer faces of the contact members will rest against the recessed faces 26*c*, 26*c'* and the outer longitudinal edge portions of the contact members will fit within the keeper grooves 26*k*, 26*k'*. When the upper edges of the contact members are flush with the upper ends of the recessed faces 26*c*, 26*c'*, the tapered contact fingers 29 project into the wireway. The contact members have tapered barbs 32 to resist movement thereof out of the bore extension 26*b*** by biting into the adjoining housing material.

When assembling the light string, the covers 30 may be positioned with the divider legs **30*b* passing through the cutouts 15 in the cord 10. Then the covers and cord can be positioned in the wireways of the housings 26 between the housing base extensions 26*o*, 26*o'*, whereupon the covers and housings can be pressed together to give them a snap-fit. This pressure also forces the contact fingers 29 through the cord insulation 14 into wire contact so that a circuit will be completed to the leads 20*a* of the lamps 20**.

Figure 1:
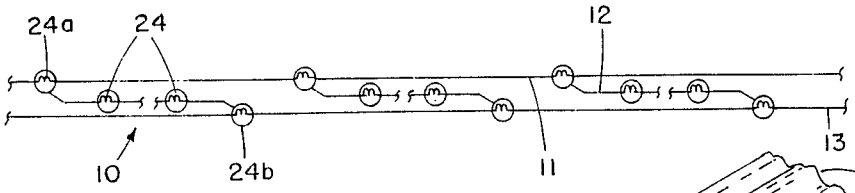
FIG. 1 is a schematic drawing of a series-parallel light string which is achieved using the present invention.

As indicated in FIG. 1, multiple sets of the lampholders 24 are placed in series with respect to center wire 12 between the parallel wires 11, 13. All of the lampholders 24 in each series set, except lampholders **24*a*, 24*b* at the two ends of the series set, have the contact plates 28, 28' arranged with their contact fingers 29 directly opposite one another so as to make contact with the center wire 12 on opposite sides of the cutouts 15. The end lampholders 24*a*, 24*b* have only one of the contact plates 28, 28' positioned so that its contact elements will make contact with the center wire 12. Each end lampholder 24*a* has one of the contact plates laterally reversed from its normal position so that its contact fingers 29 are arranged to make contact with wire 11, and each end lamp holder 24*b* has one of its contact plates laterally reversed in the opposite direction so that its contact fingers 29 will make contact with wire 13. It will be apparent that the end lampholders 24*a*, 24*b*** in each series section can be identical to the other lampholders, the only difference being the lateral reversal of one of the contact plates.

To assist in case of entry of the contact plates 28, 28' into the lampholder housing 26, it is preferred to round the entry end at the lead-in corner that is spaced from the tapered contact fingers 29. The resulting rounded edge **28*a* is complemented by the taper of the outer edge 29*b* of the outermost finger in guiding the contact plates into position in the housing 26 during assembly. In this regard, the contact plates 28** are adapted to be nested like staples loaded in a magazine and spring fed for dispensing into the lampholders by a pressure element, thus making assembly easier and more economical.

Although it is preferred to use a pair of tapered fingers as the contact element for the contact plates 28, it will be appreciated that a single tapered contact element can be used which is centered over the wire to be contacted so as to pierce the insulation and contact the wire by its point.

Referring to FIGS. 8 and 9, it is seen that the lampholder housing can be injection-molded as one piece, designated 24', and that the socket end portion can have the same interior configuration for receiving the contact plates 28, 28'. A two-part mold 40 is used, with one part **40*a* forming the socket end portion and the other part 40*b* forming the wireway end portion of the lampholder housing. At their meeting ends, the mold parts 40*a*, 40*b* present sets of opposed, semi-circular grooves 42, 42' for passage of the cord 10 through the mold when the two parts of the mold are placed together. The mold parts fit snugly over the cord at the grooves 42, 42' to adequately seal the mold with the cord in place. If the cutouts 15 in the center wire of the cord are preformed, the cord is preferably positioned in the mold by fitting the respective cutout 15 on a positioning pin 44 projecting into the wireway end forming part 40*b* of the mold. This positioning pin may be left in position during the molding operation or partially withdrawn to expose the cutout 15 so that it will fill with plastic. The positioning pin 44 can also be provided as part of the socket forming part 40*a*** of the mold.

As an alternative, the positioning pin 44 can function as a punch to form the cutout 15 in the center wire, either by the act of closing the mold, or by moving the pin 44 as a punch relative to the mold parts.

After the lampholder housings 24, have been molded onto the cord 10, the contact plates 28,28' are pushed into position in the housings so that their insulation-severing fingers 29 pierce the cord insulation and contact the appropriate wire. As with the two-piece lampholder housings 24, the one-piece units 24, can all be identical and the contact plates 28,28' can be identical, and yet a continuous string of lights can be formed in a series-parallel arrangement.

When the lampholders are molded directly onto the cord, several cords may be advanced in parallel-spaced relation through an injection-molding machine containing multicavity molds. The cords can have the cutouts 15 precut before reaching the molding machine and used to assist in positioning the cord in the mold, or the cords can be advanced to the molding machine in preset increments by a suitable feeder and the cutouts can then be made by a punching operation within the mold as previously described, or in any other suitable manner. If the cutouts are punched within the mold, the punch may be retracted before the molding operation so that the cutouts are filled with plastic when the lampholder housings are formed. This procedure assists in locking the lampholders in position on the cord. However, this is not essential, because the plastic forming the lampholder housings firmly grips the cord on completion of the molding operation. Locking of the lampholders on the cord is also assisted by the interfit of the insulation-piercing contact fingers 29 with the cord.

Although the lampholders 24,24' of the present invention are illustrated as being used for a series-parallel string, it will be understood that the lampholders could also be used in a series set having a two-wire cord with only wires 11 and 12. In that case, the wires 11,12 would both be connected to the contacts in the plug 16 and the end lampholder remote from the plug 16 would have its contact plates 28, 28' arranged in the same manner as lampholder **24*a* and namely with the one of its contact plates closest to the nearest lampholder 24 and the other contact element engaging wire 11. In that case, the end of wire 11 in lampholder 24*a* could be covered by an extension on the housing 26 or cover 30, or covered by an independent element. The wire 12 would terminate within lampholder 24*a* at its cutout 15** therein.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. In a method for making a lighting string:
providing a multiwire insulated cord;
forming a cutout in one wire of said cord;
enclosing said cutout and the adjacent portions of the cord in a multipart mold for a lampholder;
introducing plastic into said mold to form a lampholder on the cord which houses said cutout and adjacent portions of the cord and presents a lamp socket exposed to the cord at opposite ends of said cutout and adapted to receive two push-in contact members and a push-in lamp; and
freeing the molded lampholder and cord from the mold.

2. In a method according to claim 1:
forming said cutout at the location of said mold.

3. In a method according to claim 1:
forming said cutout within said mold.

4. In a method according to claim 1:
filling said cutout with plastic while said lampholder is being formed.

5. In a method according to claim 1:
forming said cutout away from said mold.

6. In a method according to claim 1:
using said cutout to position said cord in said mold.

7. In a method for making a lighting string:
providing a multiwire insulated cord;
forming a cutout in one wire of said cord;
positioning said cutout on a pin in a multipart mold for a lampholder and enclosing said cutout and the adjacent portions of the cord in said mold;
introducing plastic into said mold to form a lampholder on the cord which houses the respective said cutout and adjacent portions of the cord and presents a lamp socket exposed to the cord at opposite ends of the respective housing cutout;
removing the molded lampholder from the mold and moving the cord; and inserting two push-in contact members for a push-in lamp into the socket of the lampholder at opposite sides thereof so as to pierce the cord insulation and engage said one wire at opposite ends of said cutout.

8. A method of making a lighting string, comprising:

advancing a multiwire insulated cord to a molding station in increments corresponding to the spacing between lamps;

forming a cutout in one of the wires in the cord at the molding station;

enclosing said cutout and the adjacent portions of the cord in a multipart mold for a lampholder at the molding station;

introducing plastic into said mold to form a lampholder on the cord which houses the respective said cutout and presents a lamp socket exposed to the cord at opposite ends of the respective housed cutout;

opening the mold and removing the lampholder therefrom;

advancing the cord the next increment in preparation for forming the next cutout and molding the next lampholder; and inserting two push-in contact members for a push-in lamp into the socket of each lampholder so as to pierce the cord insulation and engage said one of the wires at opposite ends of the respective cutout therein.

9. A method of making a lighting string, comprising:

forming a series of cutouts in one of the wires of a multiwire insulated cord;

advancing the cord to a molding station in increments so as to position the cutouts at a molding station;

closing a multipart mold for a lampholder over the cord at the molding station so as to position the respective said cutout entirely within the mold;

introducing plastic into said mold to form a lampholder on the cord which houses the respective said cutout and presents a lamp socket exposed to the cord at opposite ends of the respective housed cutout;

opening the mold and advancing the cord to position the next cutout at the molding station; and inserting two contact members for a push-in lamp into the socket of each lampholder so as to engage said one of the wires at opposite ends of the respective cutout therein.

10. In a lighting string:

a plurality of one-piece, molded plastic lampholders, each having a cord passageway therethrough, and adapted to receive contact elements and push-in lamp units;

a cord extending through said passageways and having three coplanar wires separated by insulation, said cord being molded in position in said lampholders; and a series of cutouts in the cord severing the center one of the three wires and located entirely within said lampholders.

11. In a lighting string:

a plurality of one-piece lampholders of molded plastic, each having a wireway end and a socket end for push-in insertion of contact elements and lamp units;

a cord molded into and extending through the lampholders adjacent the wireway end thereof and having three coplanar wires separated by insulation;

a series of central openings in the cord through the center one of the three wires and located entirely within said lampholders, said central openings dividing said center wire into center wire sections;

two push-in contact elements in each lampholder on opposite ends of said central openings and contacting respective of said center wire sections; and push-in lamp units in the lampholders operatively engaging said contact elements and bridging said central openings.

12. In a lighting string according to claim 11, insulating elements extending integrally from the lampholders into said central openings.

13. In a lighting string:

a one-piece, molded plastic housing having a socket at one end to receive a push-in lamp unit, and having a wireway at the opposite end receiving three side-by-side insulated wires molded in position and occupying a central portion and first and second opposite side portions of the wireway;

said socket having contact-receiving portions at opposite sides thereof, one of said contact-receiving portions intersecting said central portion and said first opposite side portion of the wireway and the other of said contact-receiving portions intersecting said central portion and said second opposite side portion of the wireway; and a pair of contact members lodged in respective of said contact-receiving portions to be engaged by said lamp unit, said contact members each having an insulation-severing contact element projecting into said wireway, each of said contact members being reversible before being lodged in said recessed portions to have its said contact element projecting either into said central portion of the wireway or into one of said opposite side portions of the wireway.

14. A lampholder according to claim 13 in which each of said contact members has its said contact element centered in one lateral half thereof and projecting beyond the extent of the adjoining end of the other lateral one-half of the contact member.

15. A lighting string, comprising:

a plurality of series of one-piece, molded plastic lampholders with push-in light units and wireways;

a cord passing through the wireway of each of said lampholders and molded in position, said cord having three wires separated by insulation and having a respective cutout entirely within the wireway of each lampholder and severing one of said wires, said cutouts being shorter than the wireways, the other two wires being non-severed at the lampholders; and respective contact means in the lampholders piercing the cord insulation and engaging the severed wire, said contact means bridging said cutouts in the severed wire via the light units, the contact means of the first lampholder in each of said series piercing said cord insulation and making electrical contact with one of the non-severed wires, and the contact means of the last lampholder in each of said series also piercing said cord insulation and making electrical contact with the other of the non-severed wires, whereby said plurality of series of lampholders are connected in parallel.

16. A lighting string, comprising:

a plurality of series of one-piece, molded plastic lampholders with push-in units;

two continuous insulated wires passing into and out of each of said lampholders, and a third insulated wire having interrupted sections located entirely within the lampholders, said wires being firmly gripped by said lampholders respective contact means in the lampholders bridging said interrupted sections in the third wire via the lights, the contact means of the first lampholder in each of said series making electrical contact with one of the two continuous wires, and the contact means of the last lampholder in each of said series making electrical contact with the other of the two continuous wires, whereby said plurality of series of lampholders are connected in parallel.

17. A lighting string according to claim 16 in which said contact means comprises push-in contact members adapted to be inserted in said lampholders after the lampholders were molded.

18. A lighting string according to claim 16 in which said lampholders are identical.

19. A lighting string according to claim 16 in which said contact members are identical and adapted to be reversed.

20. In a method for making a lighting string:

providing a multiwire insulated cord;

forming a series of cutouts in one wire of said cord at increments of the cord length;

locating said cutouts sequentially at a lampholder-applying station;

positioning each cutout on a positioning device at said station;

housing each such positioned cutout and the adjoining portions of said cord at said station in a respective lampholder which presents a lamp socket exposed to said cord at opposite ends of the cutout and adapted to receive two push-in contact members and a push-in lamp.

21. In a method according to claim 20:

molding each lampholder onto said cord at said lampholder-applying station;

22. In a method according to claim 20:

clamping each lampholder onto said cord at said lampholder-applying station.

23. In a method for making a lighting string:

providing a multiwire, insulated cord:

sequentially forming a series of cutouts in one wire of said cord at a lampholder-applying station; and housing each such cutout and the adjoining portions of said cord at said station in a respective lampholder which presents a lamp socket exposed to said cord at opposite ends of the cutout and adapted to receive push-in contact members.

24. In a method according to claim 23:

applying a pair of push-in contact members in each said lamp socket at a location spaced from said station such as to pierce the insulation of said cord and engage said one wire at opposite ends of the respective cutout.

* * * * *